US006380700B1

(12) United States Patent
Okada

(10) Patent No.: US 6,380,700 B1
(45) Date of Patent: Apr. 30, 2002

(54) ELECTRIC DISCHARGE PROCESSING METHOD FOR AN ELECTRON TUBE USING A FIELD EMISSION COLD CATHODE DEVICE

(75) Inventor: Yuko Okada, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/544,387

(22) Filed: Apr. 6, 2000

(30) Foreign Application Priority Data

Apr. 6, 1999 (JP) ..... 11-098505

(51) Int. Cl.[7] ..... G06G 1/04

(52) U.S. Cl. ..... 315/370; 315/395; 313/414

(58) Field of Search ..... 315/8, 85, 370, 315/382, 395, 411; 313/412–415

(56) References Cited

U.S. PATENT DOCUMENTS 5,701,061 A * 12/1997 Okuyama et al. ..... 315/370
6,225,765 B1 * 5/2001 Yatsu et al. ..... 313/414

FOREIGN PATENT DOCUMENTS

JP 9-204880 8/1997
JP 10-125242 5/1998

* cited by examiner

*Primary Examiner*—Don Wong
*Assistant Examiner*—Wilson Lee
(74) *Attorney, Agent, or Firm*—Hutchins, Wheeler & Dittmar

(57) ABSTRACT

The present invention provides a method of carrying out an electric discharge processing to an electron tube having a field emission cold cathode device, wherein at least a high voltage electrode of the electron tube is maintained in a high voltage range, whilst all electrodes of the electron tube except for the at least high voltage electrode are maintained in a lower voltage range than the high voltage range.

15 Claims, 5 Drawing Sheets

ELECTRIC DISCHARGE PROCESSING METHOD FOR AN ELECTRON TUBE USING A FIELD EMISSION COLD CATHODE DEVICE

BACKGROUND OF THE INVENTION

The present invention relates to a method of forming an electron tube which uses a field emission cold cathode device as an electron source, and more particularly to an electric discharge processing method for an electrode in the vicinity of a field emission cold cathode device in an electron tube.

Electron tubes such as Braun tubes and traveling wave tubes are have electron guns. In the past. electron sources for the electron guns have comprised hot cathode such as an oxide cathode to be heated by a heater. In recent years, in place of the hot cathodes as the electron source, a field emission cold cathode has been received a great deal of attention because the field emission cold cathode is advantageous in high current density and a small velocity distribution of emitted electrons as compared to the hot cathode.

If the field emission cold cathode is used as the electron source for the Braun tube, then no power is needed for heating the cathode, resulting in a reduction of a power comsumption. The high current density provided by the field emission cold cathode allows the Brawn tube to have a high resolution. Advantages in characteristics of the field emission cold cathode allows the other electron tubes to exhibit high performances.

FIG. 1 is a fragmentary cross sectional elevation view illustrative of a conventional structure of the field emission cold cathode. An insulation layer 33 is formed over a silicon substrate 34. The insulation layer 33 has a matrix alignment of holes through which surfaces of the silicon substrate 34. Within the holes of the insulation layer 33, a plurality of micro-sized and cone-shaped emitters 32 are aligned over the silicon substrate 34. A gate electrode 31 is formed on a top surface of the insulation layer 33 except over the holes or except over the emitters 32. The gate electrode 31 lies at a near level to tops of the emitters 32. The emitters 32 are applied with a voltage through the silicon substrate 34. The gate electrode 31 is also applied with a different voltage so that a voltage is applied across the gate electrode 31 and the emitters 32, whereby an electric filed is concentrated at the top of each of the emitters 32. The concentration of the electric filed at the top of each of the emitters 32 cause an electron emission from the top of each of the emitters 32.

In Japanese laid-open patent publication No. 9-204880, it is disclosed that in place of the conventional hot cathode, the field emission cold cathode is used as the electron source of the Braun tube.

In Japanese laid-open patent publication No. 10-125242, it is disclosed to use the field emission cold cathode as the electron source of a microwave tube such as the traveling wave tube.

A conventional method of forming the conventional electron tube, for example, the Braun tube using the hot cathode as the electron source will be described. A valve is first formed which accommodates a fluorescent material screen and various internal members before an electron gun mounted with a hot cathode is then placed into a neck of the valve. The value containing the electron gun is further heated for current exhaust to cause a high vacuum in the valve, before the valve is sealed. Furthermore, a getter is flashed to form a getter film on an inside wall of the valve, so that an electric discharge processing process for the electron gun electrode or a high voltage knocking process is carried out in order to have the getter film absorb residual gases in the value to increase the degree of the vacuum. This high voltage knocking process is usually carried out in order to prevent discharge between electrodes of the electron guns in normal operations. FIG. 2 is a diagram illustrative of waveforms of a high voltage pulse applied across a high voltage side electrode and a low voltage side electrode of the electron gun in a high voltage knocking process. A voltage of the pulses is higher by two or three times than the usual voltage in the normal operation. The application of the pulses causes the discharge which eliminate or removes any wound on the electrode surface, and any dusts from the electrode surface.

The conventional field emission cold cathode has a problem with a possible breaking of the device in operation. The emitter and gate electrode are very close to each other so that a discharge is likely to be caused by an influence of a gas whereby a large current flows through the emitter during the discharge process, resulting in that the emitter is broken and a shot circuit is formed between the emitter and the gate electrode.

In order to avoid the above problem, it was proposed that a resistive layer is formed in series to the emitter to suppress or control the current in the discharge process in order to prevent the emitter from being melt and broken. This conventional device still has the following problem. If in the discharge process, a voltage of not more than about several tends voltages is applied across the emitter and the gate electrode, then the resistive layer formed in series to the emitter may prevent the emitter to be melt and broken. If, however, a higher voltage than about several tends voltages is applied across the emitter and the gate electrode, it is possible that the emitter is melt and broken.

As described above, the method of forming the electron tube using the hot cathode utilizes the electric discharge processing or the high voltage knocking process to the electrode, wherein a high voltage pulse is applied across electrodes of the electron gun during manufacturing processes for the Braun tube in order to prevent the discharge between electrodes in operation of the Braun tube. In the high voltage knocking process, discharges are frequency caused at electrodes of the electron guns and the inner walls of the valves in the vicinity of the electron guns. It has also been known to apply the electric discharge processing to other electron tubes than the Braun tube, wherein a high voltage is applied to metal electrodes in the vicinity of the devices.

If the above-described conventional method for forming the electron tube using the hot cathode as the electron source is applied to the electron tube using the field emission cold cathode as the electron source, it is possible that the field emission cold cathode device as the electron source is broken in the electric discharge process. The electron tube structure using the field emission cold cathode device as the electron source has been proposed. No electric discharge processing process to the electrodes in the vicinity of the field emission cold cathode devices in the manufacturing processes has yet been considered and investigated. If no electric discharge processing process is made in the manufacturing processes, it is possible that discharges are caused between the electrodes in operation of the electron tube, whereby the field emission cold cathode devices may be broken to make the electron tube inoperable.

In the above circumstances, it had been required to develop a novel method of electric discharge processing to electrodes in the vicinity of a field emission cold cathode device during manufacturing processes for the electron device which uses the field emission cold cathode device as the electron source free from the above problem.

SUMMARY OF THE INVENTION

Accordingly, it is an object of the present invention to provide a novel method of electric discharge processing to electrodes in the vicinity of a field emission cold cathode device during manufacturing processes for the electron device which uses the field emission cold cathode device as the electron source, whereby the electron tube is free from the above problems.

It is a further object of the present invention to provide a novel method of electric discharge processing to electrodes in the vicinity of a field emission cold cathode device during manufacturing processes for the electron device which uses the field emission cold cathode device as the electron source, thereby preventing any discharge between electrodes in the vicinity of the field emission cold cathode device in placing the electron tube in operation.

It is a still further object of the present invention to provide a novel method of electric discharge processing to electrodes in the vicinity of a field emission cold cathode device during manufacturing processes for the electron device which uses the field emission cold cathode device as the electron source, thereby preventing the field emission cold cathode device from being broken in operation.

It is yet a further object of the present invention to provide a novel method of electric discharge processing to electrodes in the vicinity of a field emission cold cathode device during manufacturing processes for the electron device which uses the field emission cold cathode device as the electron source, thereby preventing any excess discharge in the vicinity of the field emission cold cathode device in placing the electron tube in operation.

The present invention provides a method of carrying out an electric discharge processing to an electron tube having a field emission cold cathode device, wherein at least a high voltage electrode of the electron tube is maintained in a high voltage range, whilst all electrodes of the electron tube except for the at least high voltage electrode are maintained in a lower voltage range than the high voltage range.

The above and other objects, features and advantages of the present invention will be apparent from the following descriptions.

BRIEF DESCRIPTION OF THE DRAWINGS

Preferred embodiments according to the present invention will be described in detail with reference to the accompanying drawings.

DISCLOSURE OF THE INVENTION

Figure 1:
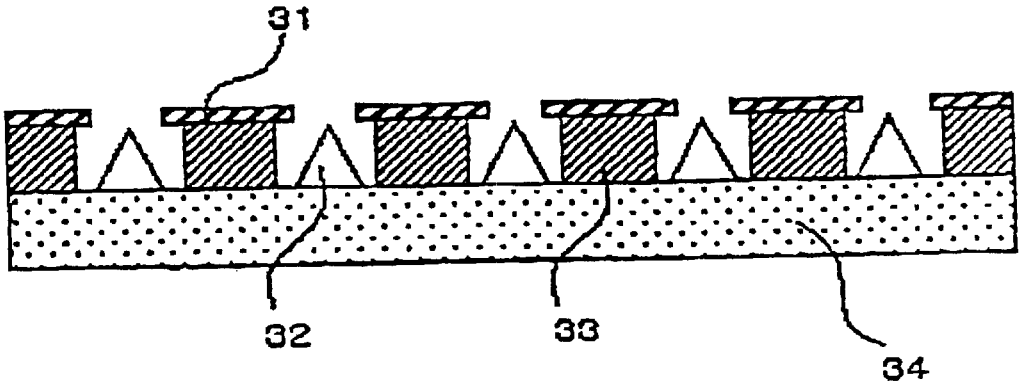
FIG. 1 prior art
FIG. 1 is a fragmentary cross sectional elevation view illustrative of a conventional structure of the field emission cold cathode.
Figure 2:
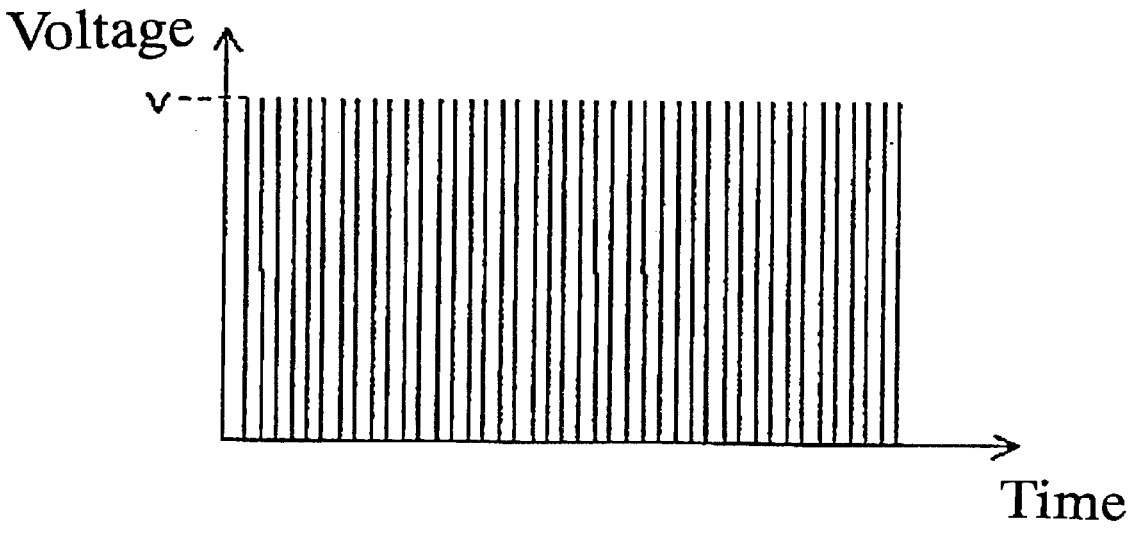
FIG. 2 prior art
FIG. 2 is a diagram illustrative of waveforms of a high voltage pulse applied across a high voltage side electrode and a low voltage side electrode of the electron gun in a high voltage knocking process.

The present invention provides a method of carrying out an electric discharge processing to an electron tube having a field emission cold cathode device, wherein at least a high voltage electrode of the electron tube is maintained in a high voltage range, whilst all electrodes of the electron tube except for the at least high voltage electrode are maintained in a lower voltage range than the high voltage range.

It is preferable that the lower voltage range has a rangewidth which corresponds to about 30% of a lowest voltage level of the high voltage range.

It is also preferable that the above all electrodes except for the above at least high voltage electrode are maintained at the same voltage lower than the high voltage range.

It is further preferable that the above all electrodes except for the at least high voltage electrode are electrically connected to each other.

It is also preferable that the above all electrodes except for the at least high voltage electrode are maintained at a ground potential.

It is also preferable that the above at least high voltage electrode is applied with high voltage pulses.

It is further preferable that applications of the high voltage pulses to the at least high voltage electrode are made with time intervals between plural sets of the high voltage pulses, and individual sets of the high voltage pulses are different in maximum pulse height, and individual maximum pulse heights of the individual sets of the high voltage pulses discontinuously increase over time.

It is also preferable that applications of the high voltage pulses to the at least high voltage electrode are made continuously without any time interval, and the pulse height of the high voltage pulses continuously increases.

The present invention provides a method of carrying out an electric discharge processing to an electron tube having a field emission cold cathode device, wherein at least a high voltage electrode of the electron tube is applied with high voltage pulses, whilst each of all electrodes of the electron tube except for the at least high voltage electrode is applied with a voltage which lies in a lower voltage range than the high voltage pulses.

It is also preferable that the lower voltage range has a rangewidth which corresponds to about 30% of a height of the high voltage pulses.

It is also preferable that the above all electrodes except for the at least high voltage electrode are applied with the same voltage lower than the high voltage.

It is further preferable that the above all electrodes except for the at least high voltage electrode are electrically connected to each other.

It is also preferable that the above all electrodes except for the at east high voltage electrode arc grounded.

It is also preferable that applications of the high voltage pulses to the at least high voltage electrode are made with time intervals between plural sets of the high voltage pulses, and individual sets of the high voltage pulses are different in maximum pulse height, and individual maximum pulse heights of the individual sets of the high voltage pulses discontinuously increase over time.

It is also preferable that applications of the high voltage pulses to the at least high voltage electrode are made continuously without any time interval, and the pulse height of the high voltage pulses continuously increases.

PREFERRED EMBODIMENT

First Embodiment

Figure 3:
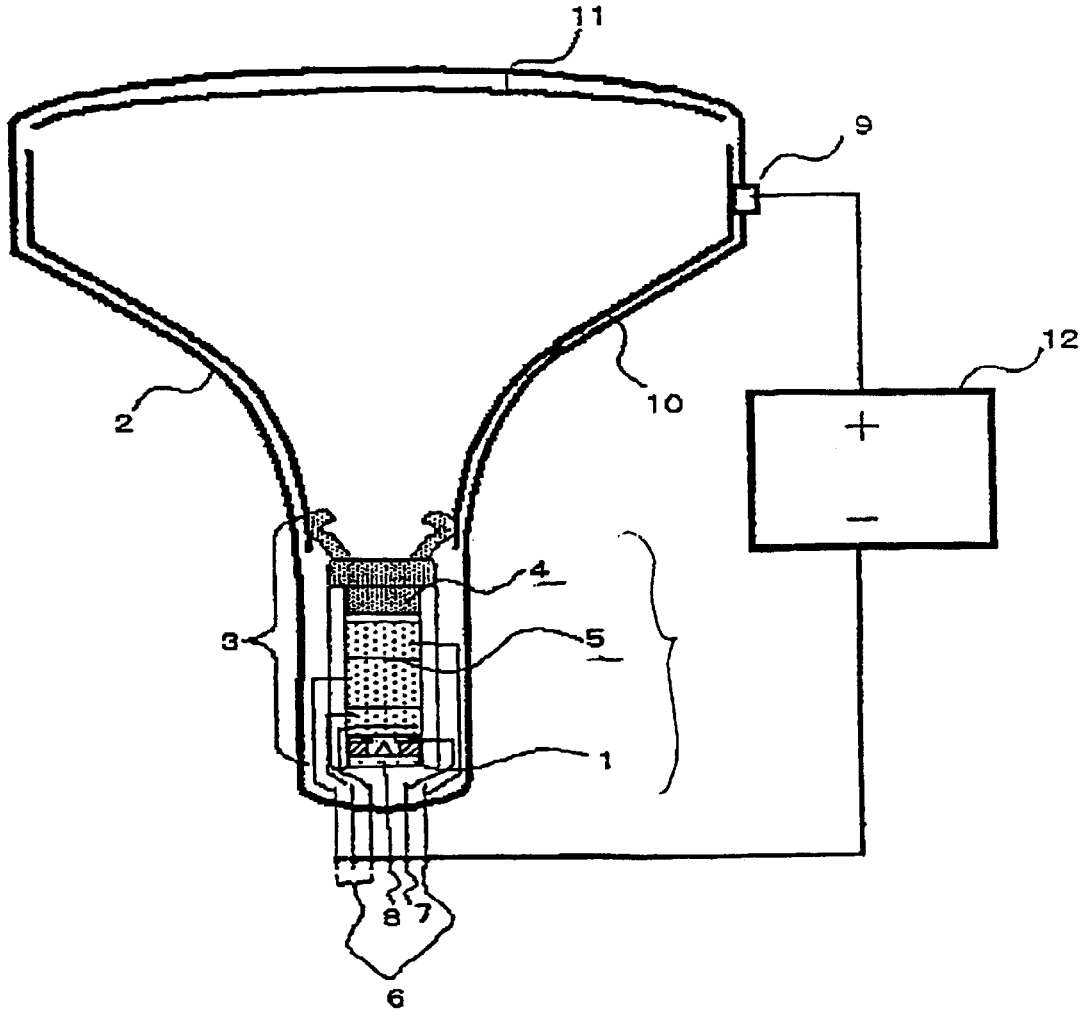
FIG. 3 is a schematic view illustrative of a Braun tube in an electric discharge processing process or a high voltage knocking process in first, third, fifth and seventh embodiments in accordance with the present invention.

A first embodiment according to the present invention will be described in detail with reference to the drawings. FIG. 3 is a schematic view illustrative of a Braun tube in an electric discharge processing process or a high voltage knocking process in a first embodiment in accordance with the present invention. The electron tube has a Braun tube 2 and an electron gun 3. The electron gun 3 has a field emission cold cathode device 1 as an electron source. The electron gun 3 also has a low voltage side electrode 5 which is positioned to be distanced by 0.8 mm from the field emission cold cathode device 1. The position of the low voltage side electrode 5 may be various depending upon the kind of the Braun tube, provided that the nearest one of the low voltage side electrodes to the field emission cold cathode device 1 is positioned within 10 mm from the field emission cold cathode device 1. A low voltage side electrode pin 6 is connected to the low voltage side electrode 5, so that a low voltage is applied through the low voltage side electrode pin 6 to the low voltage side electrode 5. A gate electrode pin 7 is connected to a gate electrode of the field emission cold cathode device 1 of the electron gun 3, so that the low voltage is applied through the gate electrode pin 7 to the gate electrode. A cathode electrode pin 8 is connected to an emitter of the field emission cold cathode device 1 of the electron gun 3, so that the low voltage is applied through the cathode electrode pin 8 to the emitter. A high voltage pulse power source 12 is provided, which has a low voltage side connected to the low voltage side electrode pin 6, the gate electrode pin 7, and the cathode electrode pin 8 as well as has a high voltage side connected to an anode button 9 which is connected to a conductive film 10 extending on an inside wall of the Braun tube 2. A fluorescent plate 11 extends on an inner side of a front of the Braun tube. A high voltage is applied through the anode button 9 to the conductive film 10 and the fluorescent plate 11. The high voltage pulse power source 12 is designed to vary in output voltage for carrying out the electric discharge processing to the electrode or the high voltage knocking process. In accordance with the present invention, all electrodes of the field emission cold cathode device 1 and the low voltage side electrode 5 of the electron gun 3 are connected to each other through the cathode electrode pin 8, the gate electrode pin 7 and the low voltage side electrode pin 6, so that the all electrodes of the field emission cold cathode device 1 have the same potential as the low voltage side electrode 5. The low voltage side of the high voltage pulse power source 12 is connected through the cathode electrode pin 8, the gate electrode pin 7 and the low voltage side electrode pin 6 to the all electrodes of the field emission cold cathode device 1 and the low voltage side electrode 5. A high voltage side electrode of the electron gun 3 is connected with the conductive film 10 which is connected to the anode button 9.

The high voltage pulse power source 12 generates high voltage pulses which vary in pulse height. The low voltage side electrode S comprises three electrodes which are aligned in a direction for electron emission and positioned between the field emission cold cathode device 1 and the high voltage side electrode 4. The three electrodes constituting the low voltage side electrode 5 and the gate electrode and the emitter electrode of the field emission cold cathode device 1 are connected to each other through the low voltage side electrode pins 6, the gate electrode pin 7 and the cathode electrode pin 8. The low voltage side electrode pins 6, the gate electrode pin 7 and the cathode electrode pin 8 are further connected to a low voltage side terminal of the high voltage pulse power source 12, so that the three electrodes constituting the low voltage side electrode 5 and the gate electrode and the emitter electrode of the field emission cold cathode device 1 are maintained at a low voltage level. A high voltage side terminal of the high voltage pulse power source 12 is connected to the anode button 9 which is connected with the conductive film 10 extending on the inner wall of the Braun tube 2. The conductive film 10 is further connected with the high voltage side electrode 4. The anode button 9 is further connected with the fluorescent plate 11 extending on the inside wall of the front of the Braun tube 2. The high voltage pulse power source 12 generates high voltage pulses which are transmitted from the high voltage side terminal through the anode button 9 and the conductive film 10 to the high voltage side electrode 4 and also to the fluorescent plate 11. The high voltage pulses have a height which is higher by a few times than a voltage usually applied thereto in normal operation. The high voltage pulses have rectangular-shaped waveforms, wherein a pulse width is set 1 second and a time interval defined between adjacent two pulses is set 1 second. During the above time interval, no voltage is applied. Application of the high voltage pulses to the high voltage side electrode 4 causes a discharge between the high voltage side electrode 4 and the low voltage side electrode 5. This discharge eliminate or removes burrs and dusts from surfaces of those electrodes. During the electric discharge processing or the high voltage knocking processing, the gate electrode and the emitter electrode as the cathode of the field emission cold cathode device 1 are connected so that the gate electrode and the emitter electrode remain at the same potential to prevent the field emission cold cathode device 1 from being broken. Elimination or removal of the burrs and dusts from surfaces of the electrodes prevents that any discharge is caused at the low voltage side electrodes 5 adjacent to the field emission cold cathode device 1 in the normal operation of the electron tube. Prevention of any discharge at the low voltage side electrodes 5 adjacent to the field emission cold cathode device 1 in the normal operation of the electron tube results in preventing the field emission cold cathode device 1 from being broken in the normal operation of the electron tube.

In this embodiment, the Bran tube is selected to be one example of the electron tubes in order to describe the present invention which provides the method of carrying out the electric discharge processing or the high voltage knocking process. Notwithstanding, the present invention is also applicable to any electron tube which has at least one field emission cold cathode device. Some types of the other electron tubes than the Braun tube have no low voltage side electrodes positioned between the field emission cold cathode device 1 and the high voltage side electrode, where the all electrodes except for the high voltage side electrode comprise the gate electrode and the emitter electrode of the field emission cold cathode device.

The present invention is applied to the other electron tube so called to as a field emission display, wherein a plurality of field emission cold cathode devices are aligned over a flat plate so that the field emission cold cathode devices emit electron beams which travel toward fluorescent plates. The gate electrode and the emitter electrode as the cathode of each of the field emission cold cathode devices are grounded so that the gate electrode and the emitter electrode have the ground potential. The fluorescent plate is applied with a high voltage to cause the discharge. This discharge eliminate or removes burrs and dusts from surfaces of those electrodes. During the electric discharge processing, the gate electrode and the emitter electrode as the cathode of each of the field emission cold cathode device are connected so that the gate electrode and the emitter electrode remain at the same potential to prevent the field emission cold cathode device from being broken. Elimination or removal of the burrs and dusts from surfaces of the electrodes prevents that any discharge is caused at the electrodes in the normal operation of the field emission display. The discharge also eliminate or remove the factors for current leak passes from inner walls of a vacuum tube or separating wall therein as well as from support columns in addition to the above effect of elimination or removal of the burrs and dusts.

Second Embodiment

Figure 4:
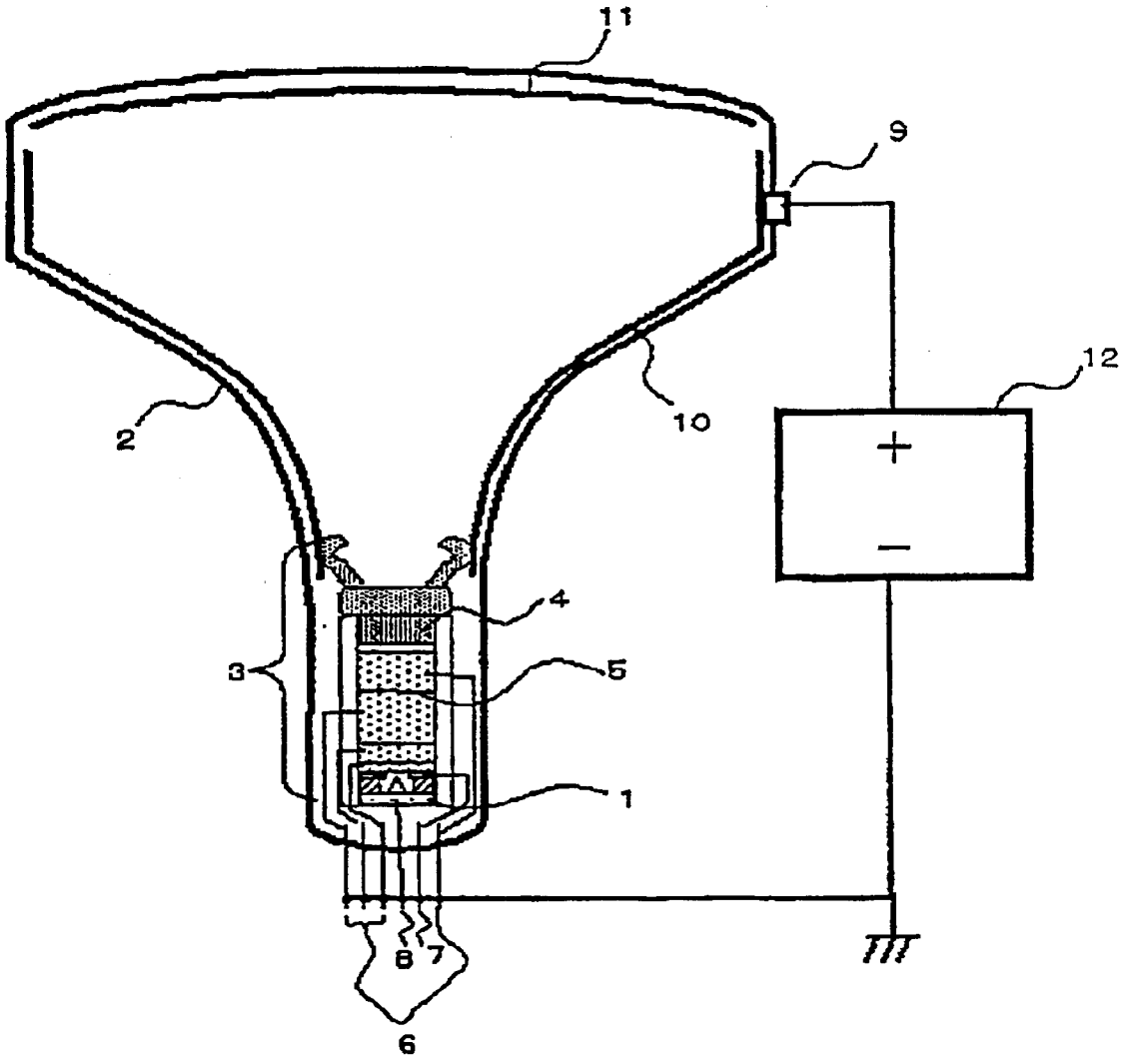
FIG. 4 is a schematic view illustrative of a Braun tube in an electric discharge processing process or a high voltage knocking process in second, fourth, sixth and eighth embodiments in accordance with the present invention.

A second embodiment according to the present invention will be described in detail with reference to the drawings. FIG. 4 is a schematic view illustrative of a Braun tube in an electric discharge processing process or a high voltage knocking process in a second embodiment in accordance with the present invention. The second embodiment is different from the first embodiment in that the low voltage side electrode, the gate electrode and the emitter of the field emission cold cathode are grounded.

The electron tube has a Braun tube 2 and an electron gun 3. The electron gun 3 has a field emission cold cathode device 1 as an electron source. The electron gun 3 also has a low voltage side electrode 5 which is positioned to be distanced by 0.8 mm from the field emission cold cathode device 1. The position of the low voltage side electrode 5 may be various depending upon the kind of the Braun tube, provided that the nearest one of the low voltage side electrodes to the field emission cold cathode device 1 is positioned within 10 mm from the field emission cold cathode device 1. A low voltage side electrode pin 6 is grounded. This low voltage side electrode pin 6 is connected to the low voltage side electrode 5, so that the ground voltage is applied through the low voltage side electrode pin 6 to the low voltage side electrode 5. A gate electrode pin 7 is also grounded. This gate electrode pin 7 is connected to a gate electrode of the field emission cold cathode device 1 of the electron gun 3, so that the ground voltage is applied through the gate electrode pin 7 to the gate electrode. A cathode electrode pin 8 is also grounded. This cathode electrode pin 8 is connected to an emitter of the field emission cold cathode device 1 of the electron gun 3, so that the ground voltage is applied through the cathode electrode pin 8 to the emitter. A high voltage pulse power source 12 is provided, which has a ground voltage side connected to the low voltage side electrode pin 6, the gate electrode pin 7, and the cathode electrode pin 8 as well as has a high voltage side connected to an anode button 9 which is connected to a conductive film 10 extending on an inside wall of the Braun tube 2. A fluorescent plate 11 extends on an inner side of a front of the Braun tube. A high voltage is applied through the anode button 9 to the conductive film 10 and the fluorescent plate 11. The high voltage pulse power source 12 is designed to vary in output voltage for carrying out the electric discharge processing to the electrode or the high voltage knocking process. In accordance with the present invention, all electrodes of the field emission cold cathode device 1 and the low voltage side electrode 5 of the electron gun 3 are connected to each other through the cathode electrode pin 8, the gate electrode pin 7 and the low voltage side electrode pin 6, so that the all electrodes of the field emission cold cathode device 1 and the low voltage side electrode 5 have the ground potential. The low voltage side of the high voltage pulse power source 12 is grounded and also connected through the cathode electrode pin 8, the gate electrode pin 7 and the low voltage side electrode pin 6 to the all electrodes of the field emission cold cathode device 1 and the low voltage side electrode 5. A high voltage side electrode of the electron gun 3 is connected with the conductive film 10 which is connected to the anode button 9.

The high voltage pulse power source 12 generates high voltage pulses which vary in pulse height. The low voltage side electrode 5 comprises three electrodes which are aligned in a direction for electron emission and positioned between the field emission cold cathode device 1 and the high voltage side electrode 4. The three electrodes constituting the low voltage side electrode 5 and the gate electrode and the emitter electrode of the field emission cold cathode device 1 are grounded and connected to each other through the low voltage side electrode pins 6, the gate electrode pin 7 and the cathode electrode pin 8. The low voltage side electrode pins 6, the gate electrode pin 7 and the cathode electrode pin 8 are further connected to a ground voltage side terminal of the high voltage pulse power source 12, so that the three electrodes constituting the low voltage side electrode 5 and the gate electrode and the emitter electrode of the field emission cold cathode device 1 are maintained at the ground voltage level. A high voltage side terminal of the high voltage pulse power source 12 is connected to the anode button 9 which is connected with the conductive film 10 extending on the inner wall of the Braun tube 2. The conductive film 10 is further connected with the high voltage side electrode 4. The anode button 9 is further connected with the fluorescent plate 11 extending on the inside wall of the front of the Braun tube 2. The high voltage pulse power source 12 generates high voltage pulses which are transmitted from the high voltage side terminal through the anode button 9 and the conductive film 10 to the high voltage side electrode 4 and also to the fluorescent plate 11. The high voltage pulses have a height which is higher by a few times than a voltage usually applied thereto in normal operation. The high voltage pulses have rectangular-shaped waveforms, wherein a pulse width is set 1 second and a time interval defined between adjacent two pulses is set 1 second. During the above time interval, no voltage is applied. Application of the high voltage pulses to the high voltage side electrode 4 causes a discharge between the high voltage side electrode 4 and the low voltage side electrode 5. This discharge eliminate or removes burrs and dusts from surfaces of those electrodes. During the electric discharge processing or the high voltage knocking processing, the gate electrode and the emitter electrode as the cathode of the field emission cold cathode device 1 are connected so that the gate electrode and the emitter electrode remain at the same potential to prevent the field emission cold cathode device 1 from being broken. Elimination or removal of the burrs and dusts from surfaces of the electrodes prevents that any discharge is caused at the low voltage side electrodes 5 adjacent to the field emission cold cathode device 1 in the normal operation of the electron tube. Prevention of any discharge at the low voltage side electrodes 5 adjacent to the field emission cold cathode device 1 in the normal operation of the electron tube results in preventing the field emission cold cathode device 1 from being broken in the normal operation of the electron tube.

In this embodiment, the Bran tube is selected to be one example of the electron tubes in order to describe the present invention which provides the method of carrying out the electric discharge processing or the high voltage knocking process. Notwithstanding, the present invention is also applicable to any electron tube which has at least one field emission cold cathode device. Some types of the other electron tubes than the Braun tube have no low voltage side electrodes positioned between the field emission cold cathode device 1 and the high voltage side electrode, where the all electrodes except for the high voltage side electrode comprise the gate electrode and the emitter electrode of the field emission cold cathode device.

The present invention is applied to the other electron tube so called to as a field emission display, wherein a plurality of field emission cold cathode devices are aligned over a flat plate so that the field emission cold cathode devices emit electron beams which travel toward fluorescent plates. The gate electrode and the emitter electrode as the cathode of each of the field emission cold cathode devices are grounded so that the gate electrode and the emitter electrode have the ground potential. The fluorescent plate is applied with a high voltage to cause the discharge. This discharge eliminate or removes burrs and dusts from surfaces of those electrodes. During the electric discharge processing, the gate electrode and the emitter electrode as the cathode of each of the field emission cold cathode device are connected so that the gate electrode and the emitter electrode remain at the same potential to prevent the field emission cold cathode device from being broken. Elimination or removal of the burrs and dusts from surfaces of the electrodes prevents that any discharge is caused at the electrodes in the normal operation of the field emission display. The discharge also eliminate or remove the factors for current leak passes from inner walls of a vacuum tube or separating wall therein as well as from support columns in addition to the above effect of elimination or removal of the burrs and dusts.

Third Embodiment

A third embodiment according to the present invention will be described in detail with reference to the drawings. FIG. 3 is a schematic view illustrative of a Braun tube in an electric discharge processing process or a high voltage knocking process in a third embodiment in accordance with the present invention. This third embodiment is different from the first embodiment in additional cleaning process for cleaning the low voltage side electrode pins 6, the gate electrode pin 7 and the emitter electrode pin 8 with an acid solution in order to reduce contact resistances of those pins 6, 7 and 8 before a short circuit is formed among those pins 6, 7 and 8.

The electron tube has a Braun tube 2 and an electron gun 3. The electron gun 3 has a field emission cold cathode device 1 as an electron source. The electron gun 3 also has a low voltage side electrode 5 which is positioned to be distanced by 0.8 mm from the field emission cold cathode device 1. The position of the low voltage side electrode 5 may be various depending upon the kind of the Braun tube, provided that the nearest one of the low voltage side electrodes to the field emission cold cathode device 1 is positioned within 10 mm from the field emission cold cathode device 1. A low voltage side electrode pin 6 is connected to the low voltage side electrode 5, so that a low voltage is applied through the low voltage side electrode pin 6 to the low voltage side electrode 5. A gate electrode pin 7 is connected to a gate electrode of the field emission cold cathode device 1 of the electron gun 3, so that the low voltage is applied through the gate electrode pin 7 to the gate electrode. A cathode electrode pin 8 is connected to an emitter of the field emission cold cathode device 1 of the electron gun 3, so that the low voltage is applied through the cathode electrode pin 8 to the emitter. A high voltage pulse power source 12 is provided, which has a low voltage side connected to the low voltage side electrode pin 6, the gate electrode pin 7, and the cathode electrode pin 8 as well as has a high voltage side connected to an anode button 9 which is connected to a conductive film 10 extending on an inside wall of the Braun tube 2. A fluorescent plate 11 extends on an inner side of a front of the Braun tube. A high voltage is applied through the anode button 9 to the conductive film 10 and the fluorescent plate 11. The high voltage pulse power source 12 is designed to vary in output voltage for carrying out the electric discharge processing to the electrode or the high voltage knocking process. In accordance with the present invention, all electrodes of the field emission cold cathode device 1 and the low voltage side electrode 5 of the electron gun 3 are connected to each other through the cathode electrode pin 8, the gate electrode pin 7 and the low voltage side electrode pin 6, so that the all electrodes of the field emission cold cathode device 1 have the same potential as the low voltage side electrode 5. The low voltage side of the high voltage pulse power source 12 is connected through the cathode electrode pin 8, the gate electrode pin 7 and the low voltage side electrode pin 6 to the all electrodes of the field emission cold cathode device 1 and the low voltage side electrode 5. A high voltage side electrode of the electron gun 3 is connected with the conductive film 10 which is connected to the anode button 9.

The high voltage pulse power source 12 generates high voltage pulses which vary in pulse height. The low voltage side electrode 5 comprises three electrodes which are aligned in a direction for electron emission and positioned between the field emission cold cathode device 1 and the high voltage side electrode 4. The three electrodes constituting the low voltage side electrode 5 and the gate electrode and the emitter electrode of the field emission cold cathode device 1 are connected to each other through the low voltage side electrode pins 6, the gate electrode pin 7 and the cathode electrode pin 8. The low voltage side electrode pins 6, the gate electrode pin 7 and the cathode electrode pin 8 are further connected to a low voltage side terminal of the high voltage pulse power source 12, so that the three electrodes constituting the low voltage side electrode 5 and the gate electrode and the emitter electrode of the field emission cold cathode device 1 are maintained at a low voltage level. A high voltage side terminal of the high voltage pulse power source 12 is connected to the anode button 9 which is connected with the conductive film 10 extending on the inner wall of the Braun tube 2. The conductive film 10 is further connected with the high voltage side electrode 4. The anode button 9 is further connected with the fluorescent plate 11 extending on the inside wall of the front of the Braun tube 2.

Prior to the electric discharge processing, additional cleaning process is carried out for cleaning the low voltage side electrode pins 6, the gate electrode pin 7 and the emitter electrode pin 8 with an acid solution in order to reduce contact resistances of those pins 6, 7 and 8 so that a short circuit is formed among those pins 6, 7 and 8. Reduction in contact resistances of those pins 6, 7 and 8 prevents that any potential difference among those pins 6, 7 and 8 due to the contact resistances. Those pins 6, 7 and 8 may be made of nickel. If those pins 6, 7 and 8 are heated, it is possible that those pins 6, 7 and 8 are partially oxidized, whereby the contact resistances are increased. The cleaning process is thus carried out to remove the oxidized parts of the pins 6, 7 and 8 to reduce the contact resistances thereof, so that a short circuit is formed among those pins 6, 7 and 8 before the electric discharge processing is carried out.

The high voltage pulse power source 12 generates high voltage pulses which are transmitted from the high voltage side terminal through the anode button 9 and the conductive film 10 to the high voltage side electrode 4 and also to the fluorescent plate 11. The high voltage pulses have a height which is higher by a few times than a voltage usually applied thereto in normal operation. The high voltage pulses have rectangular-shaped waveforms, wherein a pulse width is set 1 second and a time interval defined between adjacent two pulses is set 1 second. During the above time interval, no voltage is applied. Application of the high voltage pulses to the high voltage side electrode 4 causes a discharge between the high voltage side electrode 4 and the low voltage side electrode 5. This discharge eliminate or removes burrs and dusts from surfaces of those electrodes. During the electric discharge processing or the high voltage knocking processing, the gate electrode and the emitter electrode as the cathode of the field emission cold cathode device 1 are connected so that the gate electrode and the emitter electrode remain at the same potential to prevent the field emission cold cathode device 1 from being broken. Elimination or removal of the burrs and dusts from surfaces of the electrodes prevents that any discharge is caused at the low voltage side electrodes 5 adjacent to the field emission cold cathode device 1 in the normal operation of the electron tube. Prevention of any discharge at the low voltage side electrodes 5 adjacent to the field emission cold cathode device 1 in the normal operation of the electron tube results in preventing the field emission cold cathode device 1 from being broken in the normal operation of the electron tube.

In this embodiment, the Bran tube is selected to be one example of the electron tubes in order to describe the present invention which provides the method of carrying out the electric discharge processing or the high voltage knocking process. Notwithstanding, the present invention is also applicable to any electron tube which has at least one field emission cold cathode device. Some types of the other electron tubes than the Braun tube have no low voltage side electrodes positioned between the field emission cold cathode device 1 and the high voltage side electrode, where the all electrodes except for the high voltage side electrode comprise the gate electrode and the emitter electrode of the field emission cold cathode device.

The present invention is applied to the other electron tube so called to as a field emission display, wherein a plurality of field emission cold cathode devices are aligned over a flat plate so that the field emission cold cathode devices emit electron beams which travel toward fluorescent plates. The gate electrode and the emitter electrode as the cathode of each of the field emission cold cathode devices are grounded so that the gate electrode and the emitter electrode have the ground potential. The fluorescent plate is applied with a high voltage to cause the discharge. This discharge eliminate or removes burrs and dusts from surfaces of those electrodes. During the electric discharge processing, the gate electrode and the emitter electrode as the cathode of each of the field emission cold cathode device are connected so that the gate electrode and the emitter electrode remain at the same potential to prevent the field emission cold cathode device from being broken. Elimination or removal of the burrs and dusts from surfaces of the electrodes prevents that any discharge is caused at the electrodes in the normal operation of the field emission display. The discharge also eliminate or remove the factors for current leak passes from inner walls of a vacuum tube or separating wall therein as well as from support columns in addition to the above effect of elimination or removal of the burrs and dusts.

Fourth Embodiment

A fourth embodiment according to the present invention will be described in detail with reference to the drawings. FIG. 4 is a schematic view illustrative of a Braun tube in an electric discharge processing process or a high voltage knocking process in a fourth embodiment in accordance with the present invention. This fourth embodiment is different from the second embodiment in additional cleaning process for cleaning the low voltage side electrode pins 6, the gate electrode pin 7 and the emitter electrode pin 8 with an acid solution in order to reduce contact resistances of those pins 6, 7 and 8 before a short circuit is formed among those pins 6, 7 and 8.

The electron tube has a Braun tube 2 and an electron gun 3. The electron gun 3 has a field emission cold cathode device 1 as an electron source. The electron gun 3 also has a low voltage side electrode 5 which is positioned to be distanced by 0.8 mm from the field emission cold cathode device 1. The position of the low voltage side electrode 5 may be various depending upon the kind of the Braun tube, provided that the nearest one of the low voltage side electrodes to the field emission cold cathode device 1 is positioned within 10 mm from the field emission cold cathode device 1. A low voltage side electrode pin 6 is grounded. This low voltage side electrode pin 6 is connected to the low voltage side electrode 5, so that the ground voltage is applied through the low voltage side electrode pin 6 to the low voltage side electrode 5. A gate electrode pin 7 is also grounded. This gate electrode pin 7 is connected to a gate electrode of the field emission cold cathode device 1 of the electron gun 3, so that the ground voltage is applied through the gate electrode pin 7 to the gate electrode. A cathode electrode pin 8 is also grounded. This cathode electrode pin 8 is connected to an emitter of the field emission cold cathode device 1 of the electron gun 3, so that the ground voltage is applied through the cathode electrode pin 8 to the emitter. A high voltage pulse power source 12 is provided, which has a ground voltage side connected to the low voltage side electrode pin 6, the gate electrode pin 7, and the cathode electrode pin 8 as well as has a high voltage side connected to an anode button 9 which is connected to a conductive film 10 extending on an inside wall of the Braun tube 2. A fluorescent plate 11 extends on an inner side of a front of the Braun tube. A high voltage is applied through the anode button 9 to the conductive film 10 and the fluorescent plate 11. The high voltage pulse power source 12 is designed to vary in output voltage for carrying out the electric discharge processing to the electrode or the high voltage knocking process. In accordance with the present invention, all electrodes of the field emission cold cathode device 1 and the low voltage side electrode 5 of the electron gun 3 are connected to each other through the cathode electrode pin 8, the gate electrode pin 7 and the low voltage side electrode pin 6, so that the all electrodes of the field emission cold cathode device 1 and the low voltage side electrode 5 have the ground potential. The low voltage side of the high voltage pulse power source 12 is grounded and also connected through the cathode electrode pin 8, the gate electrode pin 7 and the low voltage side electrode pin 6 to the all electrodes of the field emission cold cathode device 1 and the low voltage side electrode 5. A high voltage side electrode of the electron gun 3 is connected with the conductive film 10 which is connected to the anode button 9.

The high voltage pulse power source 12 generates high voltage pulses which vary in pulse height. The low voltage side electrode 5 comprises three electrodes which are aligned in a direction for electron emission and positioned between the field emission cold cathode device 1 and the high voltage side electrode 4. The three electrodes constituting the low voltage side electrode 5 and the gate electrode and the emitter electrode of the field emission cold cathode device 1 are grounded and connected to each other through the low voltage side electrode pins 6, the gate electrode pin 7 and the cathode electrode pin 8. The low voltage side electrode pins 6, the gate electrode pin 7 and the cathode electrode pin 8 are further connected to a ground voltage side terminal of the high voltage pulse power source 12, so that the three electrodes constituting the low voltage side electrode 5 and the gate electrode and the emitter electrode of the field emission cold cathode device 1 are maintained at the ground voltage level. A high voltage side terminal of the high voltage pulse power source 12 is connected to the anode button 9 which is connected with the conductive film 10 extending on the inner wall of the Braun tube 2. The conductive film 10 is further connected with the high voltage side electrode 4. The anode button 9 is further connected with the fluorescent plate 11 extending on the inside wall of the front of the Braun tube 2.

Prior to the electric discharge processing, additional cleaning process is carried out for cleaning the low voltage side electrode pins 6, the gate electrode pin 7 and the emitter electrode pin 8 with an acid solution in order to reduce contact resistances of those pins 6, 7 and 8 so that a short circuit is formed among those pins 6, 7 and 8. Reduction in contact resistances of those pins 6, 7 and 8 prevents that any potential difference among those pins 6, 7 and 8 due to the contact resistances. Those pins 6, 7 and 8 may be made of nickel. If those pins 6, 7 and 8 are heated, it is possible that those pins 6, 7 and 8 are partially oxidized, whereby the contact resistances are increased. The cleaning process is thus carried out to remove the oxidized parts of the pins 6, 7 and 8 to reduce the contact resistances thereof, so that a short circuit is formed among those pins 6, 7 and 8 before the electric discharge processing is carried out.

The high voltage pulse power source 12 generates high voltage pulses which are transmitted from the high voltage side terminal through the anode button 9 and the conductive film 10 to the high voltage side electrode 4 and also to the fluorescent plate 11. The high voltage pulses have a height which is higher by a few times than a voltage usually applied thereto in normal operation. The high voltage pulses have rectangular-shaped waveforms, wherein a pulse width is set 1 second and a time interval defined between adjacent two pulses is set 1 second. During the above time interval, no voltage is applied. Application of the high voltage pulses to the high voltage side electrode 4 causes a discharge between the high voltage side electrode 4 and the low voltage side electrode 5. This discharge eliminate or removes burrs and dusts from surfaces of those electrodes. During the electric discharge processing or the high voltage knocking processing, the gate electrode and the emitter electrode as the cathode of the field emission cold cathode device 1 are connected so that the gate electrode and the emitter electrode remain at the same potential to prevent the field emission cold cathode device 1 from being broken. Elimination or removal of the burrs and dusts from surfaces of the electrodes prevents that any discharge is caused at the low voltage side electrodes 5 adjacent to the field emission cold cathode device 1 in the normal operation of the electron tube. Prevention of any discharge at the low voltage side electrodes 5 adjacent to the field emission cold cathode device 1 in the normal operation of the electron tube results in preventing the field emission cold cathode device 1 from being broken in the normal operation of the electron tube.

In this embodiment, the Bran tube is selected to be one example of the electron tubes in order to describe the present invention which provides the method of carrying out the electric discharge processing or the high voltage knocking process. Notwithstanding, the present invention is also applicable to any electron tube which has at least one field emission cold cathode device. Some types of the other electron tubes than the Braun tube have no low voltage side electrodes positioned between the field emission cold cathode device 1 and the high voltage side electrode, where the all electrodes except for the high voltage side electrode comprise the gate electrode and the emitter electrode of the field emission cold cathode device.

The present invention is applied to the other electron tube so called to as a field emission display, wherein a plurality of field emission cold cathode devices are aligned over a flat plate so that the field emission cold cathode devices emit electron beams which travel toward fluorescent plates. The gate electrode and the emitter electrode as the cathode of each of the field emission cold cathode devices are grounded so that the gate electrode and the emitter electrode have the ground potential. The fluorescent plate is applied with a high voltage to cause the discharge. This discharge eliminate or removes burrs and dusts from surfaces of those electrodes. During the electric discharge processing, the gate electrode and the emitter electrode as the cathode of each of the field emission cold cathode device are connected so that the gate electrode and the emitter electrode remain at the same potential to prevent the field emission cold cathode device from being broken. Elimination or removal of the burrs and dusts from surfaces of the electrodes prevents that any discharge is caused at the electrodes in the normal operation of the field emission display. The discharge also eliminate or remove the factors for current leak passes from inner walls of a vacuum tube or separating wall therein as well as from support columns in addition to the above effect of elimination or removal of the burrs and dusts.

Fifth Embodiment

A fifth embodiment according to the present invention will be described in detail with reference to the drawings. FIG. 3 is a schematic view illustrative of a Braun tube in an electric discharge processing process or a high voltage knocking process in a fifth embodiment in accordance with the present invention. This fifth embodiment is different from the first embodiment in modified application of high voltage pulses to the high voltage side electrode of the electron tube.

The electron tube has a Braun tube 2 and an electron gun 3. The electron gun 3 has a field emission cold cathode device 1 as an electron source. The electron gun 3 also has a low voltage side electrode 5 which is positioned to be distanced by 0.8 mm from the field emission cold cathode device 1. The position of the low voltage side electrode S may be various depending upon the kind of the Braun tube, provided that the nearest one of the low voltage side electrodes to the field emission cold cathode device 1 is positioned within 10 mm from the field emission cold cathode device 1. A low voltage side electrode pin 6 is connected to the low voltage side electrode 5, so that a low voltage is applied through the low voltage side electrode pin 6 to the low voltage side electrode 5. A gate electrode pin 7 is connected to a gate electrode of the field emission cold cathode device 1 of the electron gun 3, so that the low voltage is applied through the gate electrode pin 7 to the gate electrode. A cathode electrode pin 8 is connected to an emitter of the field emission cold cathode device 1 of the electron gun 3, so that the low voltage is applied through the cathode electrode pin 8 to the emitter. A high voltage pulse power source 12 is provided, which has a low voltage side connected to the low voltage side electrode pin 6, the gate electrode pin 7, and the cathode electrode pin 8 as well as has a high voltage side connected to an anode button 9 which is connected to a conductive film 10 extending on an inside wall of the Braun tube 2. A fluorescent plate 11 extends on an inner side of a front of the Braun tube. A high voltage is applied through the anode button 9 to the conductive film 10 and the fluorescent plate 11. The high voltage pulse power source 12 is designed to vary in output voltage for carrying out the electric discharge processing to the electrode or the high voltage knocking process. In accordance with the present invention, all electrodes of the field emission cold cathode device 1 and the low voltage side electrode 5 of the electron gun 3 are connected to each other through the cathode electrode pin 8, the gate electrode pin 7 and the low voltage side electrode pin 6, so that the all electrodes of the field emission cold cathode device 1 have the same potential as the low voltage side electrode 5. The low voltage side of the high voltage pulse power source 12 is connected through the cathode electrode pin 8, the gate electrode pin 7 and the low voltage side electrode pin 6 to the all electrodes of the field emission cold cathode device 1 and the low voltage side electrode 5. A high voltage side electrode of the electron gun 3 is connected with the conductive film 10 which is connected to the anode button 9.

The high voltage pulse power source 12 generates high voltage pulses which vary in pulse height. The low voltage side electrode 5 comprises three electrodes which are aligned in a direction for electron emission and positioned between the field emission cold cathode device 1 and the high voltage side electrode 4. The three electrodes constituting the low voltage side electrode 5 and the gate electrode and the emitter electrode of the field emission cold cathode device 1 are connected to each other through the low voltage side electrode pins 6, the gate electrode pin 7 and the cathode electrode pin 8. The low voltage side electrode pins 6, the gate electrode pin 7 and the cathode electrode pin 8 are further connected to a low voltage side terminal of the high voltage pulse power source 12, so that the three electrodes constituting the low voltage side electrode 5 and the gate electrode and the emitter electrode of the field emission cold cathode device 1 are maintained at a low voltage level. A high voltage side terminal of the high voltage pulse power source 12 is connected to the anode button 9 which is connected with the conductive film 10 extending on the inner wall of the Braun tube 2. The conductive film 10 is further connected with the high voltage side electrode 4. The anode button 9 is further connected with the fluorescent plate 11 extending on the inside wall of the front of the Braun tube 2.

Figure 5:
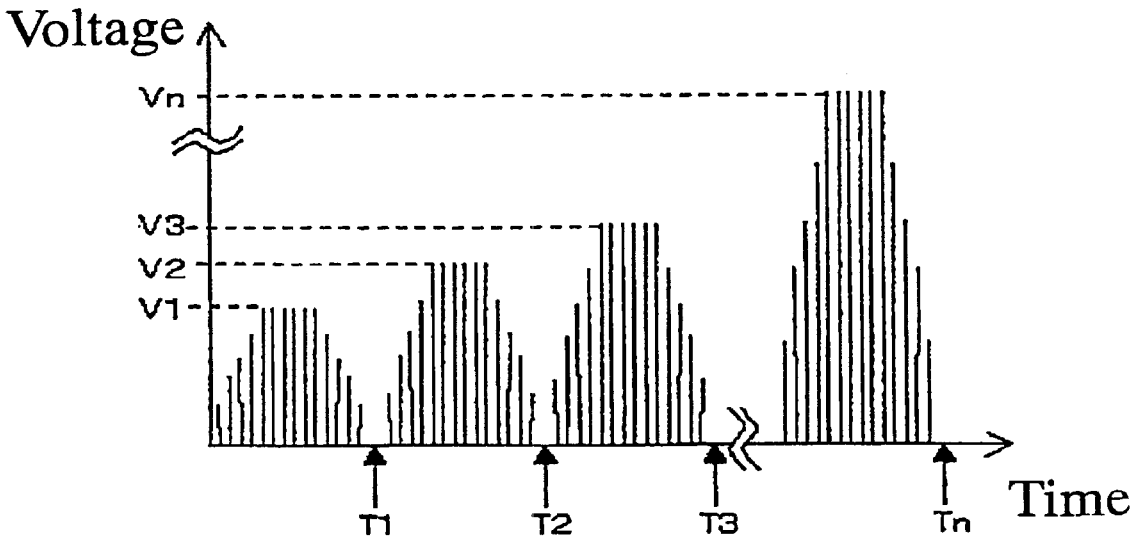
FIG. 5 is a view illustrative of waveforms of high voltage pulses in modified application to the high voltage side electrode in fifth through eighth embodiments in accordance with the present invention.

The high voltage pulse power source 12 generates high voltage pulses which are transmitted from the high voltage side terminal through the anode button 9 and the conductive film 10 to the high voltage side electrode 4 and also to the fluorescent plate 11. FIG. 5 is a view illustrative of waveforms of high voltage pulses in modified application to the high voltage side electrode 4. Plural sets of high voltage pulses are applied to the high voltage with individual time intervals T1, T2, T3, - - - Tn. Each set comprises plural high voltage pulses. Each of the high voltage pulses has a rectangular-shaped waveform. The plural high voltage pulses are uniform in pulse width. The pulse width is set 1 second. A time interval between adjacent two of the plural high voltage pulses is also uniform. The time interval is set 1 second. Each set comprises an initial time period, an intermediate time period and a later time period. In the initial time period, plural high voltage pulses are applied, where the high voltage pulses increase in pulse height up to an individually predetermined voltage level which is differently decided for every sets. In the intermediate time period, a predetermined number of the high voltage pulses having the uniform pulse height of the individually predetermined voltage level are applied. In the later time period, the plural high voltage pulses are applied, where the high voltage pulses decrease in pulse height to zero voltage from the above individually predetermined voltage level. For example, in the initial time period of the first set, the high voltage pulses increase in pulse height up to a first voltage level V1 which is substantially equal to a high voltage to be applied to the high voltage side electrode in the normal operation of the electron tube. In the intermediate time period of the first set, a predetermined number of the high voltage pulses having the uniform pulse height of the first voltage level V1 are applied. In the later time period of the first set, the high voltage pulses decrease in pulse height to zero voltage from the above first voltage level V1. The second set is started with a first time interval T1 after the first set. In the initial time period of the second set, the high voltage pulses increase in pulse height up to a second voltage level V2 which is higher than the above first voltage level V1. In the intermediate time period of the second set, a predetermined number of the high voltage pulses having the uniform pulse height of the second voltage level V2 are applied. In the later time period of the second set, the high voltage pulses decrease in pulse height to zero voltage from the above second voltage level V2. The third set is started with a second time interval T2 after the second set. In the initial time period of the third set, the high voltage pulses increase in pulse height up to a third voltage level V3 which is higher than the above second voltage level V2. In the intermediate time period of the third set, a predetermined number of the high voltage pulses having the uniform pulse height of the third voltage level V3 are applied. In the later time period of the third set, the high voltage pulses decrease in pulse height to zero voltage from the above third voltage level V3. The above processes are repeated. In the initial time period, the pulse height or the voltage level of the pulses increases to cause the discharge. In the intermediate time period, the discharge is maintained. In the later time period, the pulse height or the voltage level of the pulses decreases to discontinue the discharge. If the pulse height or the voltage level of the pulses becomes dropped to about 1.5 times of the first voltage level V1 or the normal high voltage level to be applied in the normal operation of the electron tube, then the above process for application of the pulses are ended. No further set of the high voltage pulses is applied.

In the initial set of the high voltage pulses, there exist many discharge deriving substances which contribute to derive the discharge, for which reason a discharge is likely to be caused. The discharge eliminates or remove the discharge deriving substances from the surfaces of the electrodes whereby the discharge is made weaken gradually. If, contrary to this embodiment, in the first set, the pulse height of the high voltage pulses is set higher than the first voltage level V1, then an excessively intense or strong discharge may be caused whereby the field emission cold cathode device may be broken even the gate electrode and the emitter are connected to each other so that the gate electrode and the emitter have the same potential. In order to avoid this problem, in this embodiment, the high voltage pulses with the waveforms as illustrated in FIG. 5 are applied. the first voltage level V1 of the high voltage pulses in the first set is set substantially equal to the normal high voltage to be applied to the high voltage side electrode in the normal operation of the electron tube in order to suppress the strong or intense discharge thereby preventing the field emission cold cathode device from being broken. As described above, the discharge eliminates or remove the discharge deriving substances from the electrode surfaces. As an amount of the discharge deriving substances on the electrode surfaces is reduced, the voltage level is increased gradually. If the discontinuation or disappearance of the discharge is caused at the time when the pulse height or the voltage level of the high voltage pulses becomes reduced to about 1.5 times of the first voltage level V1 or the normal high voltage level to be applied to the high voltage side electrode in the normal operation of the electron tube, then it may be considered that the discharge processing is sufficient, for which reason no further set of the high voltage pulse is applied, or the application of the high voltage pulses to the high voltage side electrode is finished. Any unnecessary electric discharge processing can be prevented.

In this embodiment, the Bran tube is selected to be one example of the electron tubes in order to describe the present invention which provides the method of carrying out the electric discharge processing or the high voltage knocking process. Notwithstanding, the present invention is also applicable to any electron tube which has at least one field emission cold cathode device. Some types of the other electron tubes than the Braun tube have no low voltage side electrodes positioned between the field emission cold cathode device 1 and the high voltage side electrode, where the all electrodes except for the high voltage side electrode comprise the gate electrode and the emitter electrode of the field emission cold cathode device.

The present invention is applied to the other electron tube so called to as a field emission display, wherein a plurality of field emission cold cathode devices are aligned over a flat plate so that the field emission cold cathode devices emit electron beams which travel toward fluorescent plates. The gate electrode and the emitter electrode as the cathode of each of the field emission cold cathode devices are grounded so that the gate electrode and the emitter electrode have the ground potential. The fluorescent plate is applied with a high voltage to cause the discharge. This discharge eliminate or removes burrs and dusts from surfaces of those electrodes. During the electric discharge processing, the gate electrode and the emitter electrode as the cathode of each of the field emission cold cathode device are connected so that the gate electrode and the emitter electrode remain at the same potential to prevent the field emission cold cathode device from being broken. Elimination or removal of the burrs and dusts from surfaces of the electrodes prevents that any discharge is caused at the electrodes in the normal operation of the field emission display. The discharge also eliminate or remove the factors for current leak passes from inner walls of a vacuum tube or separating wall therein as well as from support columns in addition to the above effect of elimination or removal of the burrs and dusts.

Sixth Embodiment

A sixth embodiment according to the present invention will be described in detail with reference to the drawings. FIG. 4 is a schematic view illustrative of a Braun tube in an electric discharge processing process or a high voltage knocking process in a sixth embodiment in accordance with the present invention. This sixth embodiment is different from the second embodiment in modified application of high voltage pulses to the high voltage side electrode of the electron tube.

The electron tube has a Braun tube 2 and an electron gun 3. The electron gun 3 has a field emission cold cathode device 1 as an electron source. The electron gun 3 also has a low voltage side electrode 5 which is positioned to be distanced by 0.8 mm from the field emission cold cathode device 1. The position of the low voltage side electrode 5 may be various depending upon the kind of the Braun tube, provided that the nearest one of the low voltage side electrodes to the field emission cold cathode device 1 is positioned within 10 mm from the field emission cold cathode device 1. A low voltage side electrode pin 6 is grounded. This low voltage side electrode pin 6 is connected to the low voltage side electrode 5 so that the ground voltage is applied through the low voltage side electrode pin 6 to the low voltage side electrode 5. A gate electrode pin 7 is also grounded. This gate electrode pin 7 is connected to a gate electrode of the field emission cold cathode device 1 of the electron gun 3, so that the ground voltage is applied through the gate electrode pin 7 to the gate electrode. A cathode electrode pin 8 is also grounded. This cathode electrode pin 8 is connected to an emitter of the field emission cold cathode device 1 of the electron gun 3, so that the ground voltage is applied through the cathode electrode pin 8 to the emitter. A high voltage pulse power source 12 is provided, which has a ground voltage side connected to the low voltage side electrode pin 6, the gate electrode pin 7, and the cathode electrode pin 8 as well as has a high voltage side connected to an anode button 9 which is connected to a conductive film 10 extending on an inside wall of the Braun tube 2. A fluorescent plate 11 extends on an inner side of a front of the Braun tube. A high voltage is applied through the anode button 9 to the conductive film 10 and the fluorescent plate 11. The high voltage pulse power source 12 is designed to vary in output voltage for carrying out the electric discharge processing to the electrode or the high voltage knocking process. In accordance with the present invention, all electrodes of the field emission cold cathode device 1 and the low voltage side electrode 5 of the electron gun 3 are connected to each other through the cathode electrode pin 8, the gate electrode pin 7 and the low voltage side electrode pin 6, so that the all electrodes of the field emission cold cathode device 1 and the low voltage side electrode 5 have the ground potential. The low voltage side of the high voltage pulse power source 12 is grounded and also connected through the cathode electrode pin 8, the gate electrode pin 7 and the low voltage side electrode pin 6 to the all electrodes of the field emission cold cathode device 1 and the low voltage side electrode 5. A high voltage side electrode of the electron gun 3 is connected with the conductive film 10 which is connected to the anode button 9.

The high voltage pulse power source 12 generates high voltage pulses which are transmitted from the high voltage side terminal through the anode button 9 and the conductive film 10 to the high voltage side electrode 4 and also to the fluorescent plate 11. FIG. 5 is a view illustrative of waveforms of high voltage pulses in modified application to the high voltage side electrode 4. Plural sets of high voltage pulses are applied to the high voltage with individual time intervals T1, T2, T3, - - - Tn. Each set comprises plural high voltage pulses. Each of the high voltage pulses has a rectangular-shaped waveform. The plural high voltage pulses are uniform in pulse width. The pulse width is set 1 second. A time interval between adjacent two of the plural high voltage pulses is also uniform. The time interval is set 1 second. Each set comprises an initial time period, an intermediate time period and a later time period. In the initial time period, plural high voltage pulses are applied, where the high voltage pulses increase in pulse height up to an individually predetermined voltage level which is differently decided for every sets. In the intermediate time period, a predetermined number of the high voltage pulses having the uniform pulse height of the individually predetermined voltage level are applied. In the later time period, the plural high voltage pulses are applied, where the high voltage pulses decrease in pulse height to zero voltage from the above individually predetermined voltage level. For example, in the initial time period of the first set, the high voltage pulses increase in pulse height up to a first voltage level V1 which is substantially equal to a high voltage to be applied to the high voltage side electrode in the normal operation of the electron tube. In the intermediate time period of the first set, a predetermined number of the high voltage pulses having the uniform pulse height of the first voltage level V1 are applied. In the later time period of the first set, the high voltage pulses decrease in pulse height to zero voltage from the above first voltage level V1. The second set is started with a first time interval T1 after the first set. In the initial time period of the second set, the high voltage pulses increase in pulse height up to a second voltage level V2 which is higher than the above first voltage level V1. In the intermediate time period of the second set, a predetermined number of the high voltage pulses having the uniform pulse height of the second voltage level V2 are applied. In the later time period of the second set, the high voltage pulses decrease in pulse height to zero voltage from the above second voltage level V2. The third set is started with a second time interval T2 after the second set. In the initial time period of the third set, the high voltage pulses increase in pulse height up to a third voltage level V3 which is higher than the above second voltage level V2. In the intermediate time period of the third set, a predetermined number of the high voltage pulses having the uniform pulse height of the third voltage level V3 are applied. In the later time period of the third set, the high voltage pulses decrease in pulse height to zero voltage from the above third voltage level V3. The above processes are repeated. In the initial time period, the pulse height or the voltage level of the pulses increases to cause the discharge. In the intermediate time period, the discharge is maintained. In the later time period, the pulse height or the voltage level of the pulses decreases to discontinue the discharge. If the pulse height or the voltage level of the pulses becomes dropped to about 1.5 times of the first voltage level V1 or the normal high voltage level to be applied in the normal operation of the electron tube, then the above process for application of the pulses are ended. No further set of the high voltage pulses is applied.

In the initial set of the high voltage pulses, there exist many discharge deriving substances which contribute to derive the discharge, for which reason a discharge is likely to be caused. The discharge eliminates or remove the discharge deriving substances from the surfaces of the electrodes whereby the discharge is made weaken gradually. If, contrary to this embodiment, in the first set, the pulse height of the high voltage pulses is set higher than the first voltage level V1, then an excessively intense or strong discharge may be caused whereby the field emission cold cathode device may be broken even the gate electrode and the emitter are connected to each other so that the gate electrode and the emitter have the same potential. In order to avoid this problem, in this embodiment, the high voltage pulses with the waveforms as illustrated in FIG. 5 are applied. the first voltage level V1 of the high voltage pulses in the first set is set substantially equal to the normal high voltage to be applied to the high voltage side electrode in the normal operation of the electron tube in order to suppress the strong or intense discharge thereby preventing the field emission cold cathode device from being broken. As described above, the discharge eliminates or remove the discharge deriving substances from the electrode surfaces. As an amount of the discharge deriving substances on the electrode surfaces is reduced, the voltage level is increased gradually. If the discontinuation or disappearance of the discharge is caused at the time when the pulse height or the voltage level of the high voltage pulses becomes reduced to about 1.5 times of the first voltage level V1 or the normal high voltage level to be applied to the high voltage side electrode in the normal operation of the electron tube, then it may be considered that the discharge processing is sufficient, for which reason no further set of the high voltage pulse is applied, or the application of the high voltage pulses to the high voltage side electrode is finished. Any unnecessary electric discharge processing can be prevented.

In this embodiment, the Bran tube is selected to be one example of the electron tubes in order to describe the present invention which provides the method of carrying out the electric discharge processing or the high voltage knocking process. Notwithstanding, the present invention is also applicable to any electron tube which has at least one field emission cold cathode device. Some types of the other electron tubes than the Braun tube have no low voltage side electrodes positioned between the field emission cold cathode device 1 and the high voltage side electrode, where the all electrodes except for the high voltage side electrode comprise the gate electrode and the emitter electrode of the field emission cold cathode device.

The present invention is applied to the other electron tube so called to as a field emission display, wherein a plurality of field emission cold cathode devices are aligned over a flat plate so that the field emission cold cathode devices emit electron beams which travel toward fluorescent plates. The gate electrode and the emitter electrode as the cathode of each of the field emission cold cathode devices are grounded so that the gate electrode and the emitter electrode have the ground potential. The fluorescent plate is applied with a high voltage to cause the discharge. This discharge eliminate or removes burrs and dusts from surfaces of those electrodes. During the electric discharge processing, the gate electrode and the emitter electrode as the cathode of each of the field emission cold cathode device are connected so that the gate electrode and the emitter electrode remain at the same potential to prevent the field emission cold cathode device from being broken. Elimination or removal of the burrs and dusts from surfaces of the electrodes prevents that any discharge is caused at the electrodes in the normal operation of the field emission display. The discharge also eliminate or remove the factors for current leak passes from inner walls of a vacuum tube or separating wall therein as well as from support columns in addition to the above effect of elimination or removal of the burrs and dusts.

Seventh Eembodiment

A seventh embodiment according to the present invention will be described in detail with reference to the drawings.

FIG. 3 is a schematic view illustrative of a Braun tube in an electric discharge processing process or a high voltage knocking process in a seventh embodiment in accordance with the present invention. This seventh embodiment is different from the third embodiment in modified application of high voltage pulses to the high voltage side electrode of the electron tube.

The electron tube has a Braun tube 2 and an electron gun 3. The electron gun 3 has a field emission cold cathode device 1 as an electron source. The electron gun 3 also has a low voltage side electrode 5 which is positioned to be distanced by 0.8 mm from the field emission cold cathode device 1. The position of the low voltage side electrode 5 may be various depending upon the kind of the Braun tube, provided that the nearest one of the low voltage side electrodes to the field emission cold cathode device 1 is positioned within 10 mm from the field emission cold cathode device 1. A low voltage side electrode pin 6 is connected to the low voltage side electrode 5, so that a low voltage is applied through the low voltage side electrode pin 6 to the low voltage side electrode 5. A gate electrode pin 7 is connected to a gate electrode of the field emission cold cathode device 1 of the electron gun 3, so that the low voltage is applied through the gate electrode pin 7 to the gate electrode. A cathode electrode pin 8 is connected to an emitter of the field emission cold cathode device 1 of the electron gun 3, so that the low voltage is applied through the cathode electrode pin 8 to the emitter. A high voltage pulse power source 12 is provided, which has a low voltage side connected to the low voltage side electrode pin 6, the gate electrode pin 7, and the cathode electrode pin 8 as well as has a high voltage side connected to an anode button 9 which is connected to a conductive film 10 extending on an inside wall of the Braun tube 2. A fluorescent plate 11 extends on an inner side of a front of the Braun tube. A high voltage is applied through the anode button 9 to the conductive film 10 and the fluorescent plate 11. The high voltage pulse power source 12 is designed to vary in output voltage for carrying out the electric discharge processing to the electrode or the high voltage knocking process. In accordance with the present invention, all electrodes of the field emission cold cathode device 1 and the low voltage side electrode 5 of the electron gun 3 are connected to each other through the cathode electrode pin 8, the gate electrode pin 7 and the low voltage side electrode pin 6, so that the all electrodes of the field emission cold cathode device 1 have the same potential as the low voltage side electrode 5. The low voltage side of the high voltage pulse power source 12 is connected through the cathode electrode pin 8, the gate electrode pin 7 and the low voltage side electrode pin 6 to the all electrodes of the field emission cold cathode device 1 and the low voltage side electrode 5. A high voltage side electrode of the electron gun 3 is connected with the conductive film 10 which is connected to the anode button 9.

The high voltage pulse power source 12 generates high voltage pulses which vary in pulse height. The low voltage side electrode 5 comprises three electrodes which are aligned in a direction for electron emission and positioned between the field emission cold cathode device 1 and the high voltage side electrode 4. The three electrodes constituting the low voltage side electrode 5 and the gate electrode and the emitter electrode of the field emission cold cathode device 1 are connected to each other through the low voltage side electrode pins 6, the gate electrode pin 7 and the cathode electrode pin 8. The low voltage side electrode pins 6, the gate electrode pin 7 and the cathode electrode pin 8 are further connected to a low voltage side terminal of the high voltage pulse power source 12, so that the three electrodes constituting the low voltage side electrode 5 and the gate electrode and the emitter electrode of the field emission cold cathode device 1 are maintained at a low voltage level. A high voltage side terminal of the high voltage pulse power source 12 is connected to the anode button 9 which is connected with the conductive film 10 extending on the inner wall of the Braun tube 2. The conductive film 10 is further connected with the high voltage side electrode 4. The anode button 9 is further connected with the fluorescent plate 11 extending on the inside wall of the front of the Braun tube 2.

Prior to the electric discharge processing, additional cleaning process is carried out for cleaning the low voltage side electrode pins 6, the gate electrode pin 7 and the emitter electrode pin 8 with an acid solution in order to reduce contact resistances of those pins 6, 7 and 8 so that a short circuit is formed among those pins 6, 7 and 8. Reduction in contact resistances of those pins 6, 7 and 8 prevents that any potential difference among those pins 6, 7 and 8 due to the contact resistances. Those pins 6, 7 and 8 may be made of nickel. If those pins 6, 7 and 8 are heated, it is possible that those pins 6, 7 and 8 are partially oxidized, whereby the contact resistances are increased. The cleaning process is thus carried out to remove the oxidized parts of the pins 6, 7 and 8 to reduce the contact resistances thereof, so that a short circuit is formed among those pins 6, 7 and 8 before the electric discharge processing is carried out.

The high voltage pulse power source 12 generates high voltage pulses which are transmitted from the high voltage side terminal through the anode button 9 and the conductive film 10 to the high voltage side electrode 4 and also to the fluorescent plate 11. FIG. 5 is a view illustrative of waveforms of high voltage pulses in modified application to the high voltage side electrode 4. Plural sets of high voltage pulses are applied to the high voltage with individual time intervals T1, T2, T3, - - - Tn. Each set comprises plural high voltage pulses. Each of the high voltage pulses has a rectangular-shaped waveform. The plural high voltage pulses are uniform in pulse width. The pulse width is set 1 second. A time interval between adjacent two of the plural high voltage pulses is also uniform. The time interval is set 1 second. Each set comprises an initial time period, an intermediate time period and a later time period. In the initial time period, plural high voltage pulses are applied, where the high voltage pulses increase in pulse height up to an individually predetermined voltage level which is differently decided for every sets. In the intermediate time period, a predetermined number of the high voltage pulses having the uniform pulse height of the individually predetermined voltage level are applied. In the later time period, the plural high voltage pulses are applied, where the high voltage pulses decrease in pulse height to zero voltage from the above individually predetermined voltage level. For example, in the initial time period of the first set, the high voltage pulses increase in pulse height up to a first voltage level V1 which is substantially equal to a high voltage to be applied to the high voltage side electrode in the normal operation of the electron tube. In the intermediate time period of the first set, a predetermined number of the high voltage pulses having the uniform pulse height of the first voltage level V1 are applied. In the later time period of the first set, the high voltage pulses decrease in pulse height to zero voltage from the above first voltage level V1. The second set is started with a first time interval T1 after the first set. In the initial time period of the second set, the high voltage pulses increase in pulse height up to a second voltage level V2 which is higher than the above first voltage level V1. In the intermediate time period of the second set, a predetermined number of the high voltage pulses having the uniform pulse height of the second voltage level V2 are applied. In the later time period of the second set, the high voltage pulses decrease in pulse height to zero voltage from the above second voltage level V2. The third set is started with a second time interval T2 after the second set. In the initial time period of the third set, the high voltage pulses increase in pulse height up to a third voltage level V3 which is higher than the above second voltage level V2. In the intermediate time period of the third set, a predetermined number of the high voltage pulses having the uniform pulse height of the third voltage level V3 are applied. In the later time period of the third set, the high voltage pulses decrease in pulse height to zero voltage from the above third voltage level V3. The above processes are repeated. In the initial time period, the pulse height or the voltage level of the pulses increases to cause the discharge. In the intermediate time period, the discharge is maintained. In the later time period, the pulse height or the voltage level of the pulses decreases to discontinue the discharge. If the pulse height or the voltage level of the pulses becomes dropped to about 1.5 times of the first voltage level V1 or the normal high voltage level to be applied in the normal operation of the electron tube, then the above process for application of the pulses are ended. No further set of the high voltage pulses is applied.

In the initial set of the high voltage pulses, there exist many discharge deriving substances which contribute to derive the discharge, for which reason a discharge is likely to be caused. The discharge eliminates or remove the discharge deriving substances from the surfaces of the electrodes whereby the discharge is made weaken gradually. If, contrary to this embodiment, in the first set, the pulse height of the high voltage pulses is set higher than the first voltage level V1, then an excessively intense or strong discharge may be caused whereby the field emission cold cathode device may be broken even the gate electrode and the emitter are connected to each other so that the gate electrode and the emitter have the same potential. In order to avoid this problem, in this embodiment, the high voltage pulses with the waveforms as illustrated in FIG. 5 are applied. the first voltage level V1 of the high voltage pulses in the first set is set substantially equal to the normal high voltage to be applied to the high voltage side electrode in the normal operation of the electron tube in order to suppress the strong or intense discharge thereby preventing the field emission cold cathode device from being broken. As described above, the discharge eliminates or remove the discharge deriving substances from the electrode surfaces. As an amount of the discharge deriving substances on the electrode surfaces is reduced, the voltage level is increased gradually. If the discontinuation or disappearance of the discharge is caused at the time when the pulse height or the voltage level of the high voltage pulses becomes reduced to about 1.5 times of the first voltage level V1 or the normal high voltage level to be applied to the high voltage side electrode in the normal operation of the electron tube, then it may be considered that the discharge processing is sufficient, for which reason no further set of the high voltage pulse is applied, or the application of the high voltage pulses to the high voltage side electrode is finished. Any unnecessary electric discharge processing can be prevented.

In this embodiment, the Bran tube is selected to be one example of the electron tubes in order to describe the present invention which provides the method of carrying out the electric discharge processing or the high voltage knocking process. Notwithstanding, the present invention is also applicable to any electron tube which has at least one field emission cold cathode device. Some types of the other electron tubes than the Braun tube have no low voltage side electrodes positioned between the field emission cold cathode device 1 and the high voltage side electrode, where the all electrodes except for the high voltage side electrode comprise the gate electrode and the emitter electrode of the field emission cold cathode device.

The present invention is applied to the other electron tube so called to as a field emission display, wherein a plurality of field emission cold cathode devices are aligned over a flat plate so that the field emission cold cathode devices emit electron beams which travel toward fluorescent plates. The gate electrode and the emitter electrode as the cathode of each of the field emission cold cathode devices are grounded so that the gate electrode and the emitter electrode have the ground potential. The fluorescent plate is applied with a high voltage to cause the discharge. This discharge eliminate or removes burrs and dusts from surfaces of those electrodes. During the electric discharge processing, the gate electrode and the emitter electrode as the cathode of each of the field emission cold cathode device are connected so that the gate electrode and the emitter electrode remain at the same potential to prevent the field emission cold cathode device from being broken. Elimination or removal of the bum and dusts from surfaces of the electrodes prevents that any discharge is caused at the electrodes in the normal operation of the field emission display. The discharge also eliminate or remove the factors for current leak passes from inner walls of a vacuum tube or separating wall therein as well as from support columns in addition to the above effect of elimination or removal of the burrs and dusts.

Eighth Embodiment

An eighth embodiment according to the present invention will be described in detail with reference to the drawings. FIG. 4 is a schematic view illustrative of a Braun tube in an electric discharge processing process or a high voltage knocking process in an eighth embodiment in accordance with the present invention. This eighth embodiment is different from the fourth embodiment in modified application of high voltage pulses to the high voltage side electrode of the electron tube.

The electron tube has a Braun tube 2 and an electron gun 3. The electron gun 3 has a field emission cold cathode device 1 as an electron source. The electron gun 3 also has a low voltage side electrode 5 which is positioned to be distanced by 0.8 mm from the field emission cold cathode device 1. The position of the low voltage side electrode 5 may be various depending upon the kind of the Braun tube, provided that the nearest one of the low voltage side electrodes to the field emission cold cathode device 1 is positioned within 10 mm from the field emission cold cathode device 1. A low voltage side electrode pin 6 is grounded. This low voltage side electrode pin 6 is connected to the low voltage side electrode 5, so that the ground voltage is applied through the low voltage side electrode pin 6 to the low voltage side electrode 5. A gate electrode pin 7 is also grounded. This gate electrode pin 7 is connected to a gate electrode of the field emission cold cathode device 1 of the electron gun 3, so that the ground voltage is applied through the gate electrode pin 7 to the gate electrode. A cathode electrode pin 8 is also grounded. This cathode electrode pin 8 is connected to an emitter of the field emission cold cathode device 1 of the electron gun 3, so that the ground voltage is applied through the cathode electrode pin 8 to the emitter. A high voltage pulse power source 12 is provided, which has a ground voltage side connected to the low voltage side electrode pin 6, the gate electrode pin 7, and the cathode electrode pin 8 as well as has a high voltage side connected to an anode button 9 which is connected to a conductive film 10 extending on an inside wall of the Braun tube 2. A fluorescent plate 11 extends on an inner side of a front of the Braun tube. A high voltage is applied through the anode button 9 to the conductive film 10 and the fluorescent plate 11. The high voltage pulse power source 12 is designed to vary in output voltage for carrying out the electric discharge processing to the electrode or the high voltage knocking process. In accordance with the present invention, all electrodes of the field emission cold cathode device 1 and the low voltage side electrode 5 of the electron gun 3 are connected to each other through the cathode electrode pin 8, the gate electrode pin 7 and the low voltage side electrode pin 6, so that the all electrodes of the field emission cold cathode device 1 and the low voltage side electrode 5 have the ground potential. The low voltage side of the high voltage pulse power source 12 is grounded and also connected through the cathode electrode pin 8, the gate electrode pin 7 and the low voltage side electrode pin 6 to the all electrodes of the field emission cold cathode device 1 and the low voltage side electrode 5. A high voltage side electrode of the electron gun 3 is connected with the conductive film 10 which is connected to the anode button 9.

The high voltage pulse power source 12 generates high voltage pulses which vary in pulse height. The low voltage side electrode 5 comprises three electrodes which are aligned in a direction for electron emission and positioned between the field emission cold cathode device 1 and the high voltage side electrode 4. The three electrodes constituting the low voltage side electrode 5 and the gate electrode and the emitter electrode of the field emission cold cathode device 1 are grounded and connected to each other through the low voltage side electrode pins 6, the gate electrode pin 7 and the cathode electrode pin 8. The low voltage side electrode pins 6, the gate electrode pin 7 and the cathode electrode pin 8 are further connected to a ground voltage side terminal of the high voltage pulse power source 12, so that the three electrodes constituting the low voltage side electrode 5 and the gate electrode and the emitter electrode of the field emission cold cathode device 1 are maintained at the ground voltage level. A high voltage side terminal of the high voltage pulse power source 12 is connected to the anode button 9 which is connected with the conductive film 10 extending on the inner wall of the Braun tube 2. The conductive film 10 is further connected with the high voltage side electrode 4. The anode button 9 is further connected with the fluorescent plate 11 extending on the inside wall of the front of the Braun tube 2.

Prior to the electric discharge processing, additional cleaning process is carried out for cleaning the low voltage side electrode pins 6, the gate electrode pin 7 and the emitter electrode pin 8 with an acid solution in order to reduce contact resistances of those pins 6, 7 and 8 so that a short circuit is formed among those pins 6, 7 and 8. Reduction in contact resistances of those pins 6, 7 and 8 prevents that any potential difference among those pins 6, 7 and 8 due to the contact resistances. Those pins 6, 7 and 8 may be made of nickel. If those pins 6, 7 and 8 are heated, it is possible that those pins 6, 7 and 8 are partially oxidized, whereby the contact resistances are increased. The cleaning process is thus carried out to remove the oxidized parts of the pins 6, 7 and 8 to reduce the contact resistances thereof, so that a short circuit is formed among those pins 6, 7 and 8 before the electric discharge processing is carried out.

The high voltage pulse power source 12 generates high voltage pulses which are transmitted from the high voltage side terminal through the anode button 9 and the conductive film 10 to the high voltage side electrode 4 and also to the fluorescent plate 11 FIG. 5 is a view illustrative of waveforms of high voltage pulses in modified application to the high voltage side electrode 4. Plural sets of high voltage pulses are applied to the high voltage with individual time intervals T1, T2, T3, - - - Tn. Each set comprises plural high voltage pulses. Each of the high voltage pulses has a rectangular-shaped waveform. The plural high voltage pulses are uniform in pulse width. The pulse width is set 1 second. A time interval between adjacent two of the plural high voltage pulses is also uniform. The time interval is set 1 second. Each set comprises an initial time period, an intermediate time period and a later time period. In the initial time period, plural high voltage pulses are applied, where the high voltage pulses increase in pulse height up to an individually predetermined voltage level which is differently decided for every sets. In the intermediate time period, a predetermined number of the high voltage pulses having the uniform pulse height of the individually predetermined voltage level are applied. In the later time period, the plural high voltage pulses are applied, where the high voltage pulses decrease in pulse height to zero voltage from the above individually predetermined voltage level. For example, in the initial time period of the first set, the high voltage pulses increase in pulse height up to a first voltage level V1 which is substantially equal to a high voltage to be applied to the high voltage side electrode in the normal operation of the electron tube. In the intermediate time period of the first set, a predetermined number of the high voltage pulses having the uniform pulse height of the first voltage level V1 are applied. In the later time period of the first set, the high voltage pulses decrease in pulse height to zero voltage from the above first voltage level V1. The second set is started with a first time interval T1 after the first set. In the initial time period of the second set, the high voltage pulses increase in pulse height up to a second voltage level V2 which is higher than the above first voltage level V1. In the intermediate time period of the second set, a predetermined number of the high voltage pulses having the uniform pulse height of the second voltage level V2 are applied. In the later time period of the second set, the high voltage pulses decrease in pulse height to zero voltage from the above second voltage level V2. The third set is started with a second time interval T2 after the second set. In the initial time period of the third set, the high voltage pulses increase in pulse height up to a third voltage level V3 which is higher than the above second voltage level V2. In the intermediate time period of the third set, a predetermined number of the high voltage pulses having the uniform pulse height of the third voltage level V3 are applied. In the later time period of the third set, the high voltage pulses decrease in pulse height to zero voltage from the above third voltage level V3. The above processes are repeated. In the initial time period, the pulse height or the voltage level of the pulses increases to cause the discharge. In the intermediate time period, the discharge is maintained. In the later time period, the pulse height or the voltage level of the pulses decreases to discontinue the discharge. If the pulse height or the voltage level of the pulses becomes dropped to about 1.5 times of the first voltage level V1 or the normal high voltage level to be applied in the normal operation of the electron tube, then the above process for application of the pulses are ended. No further set of the high voltage pulses is applied.

In the initial set of the high voltage pulses, there exist many discharge deriving substances which contribute to derive the discharge, for which reason a discharge is likely to be caused. The discharge eliminates or remove the discharge deriving substances from the surfaces of the electrodes whereby the discharge is made weaken gradually. If, contrary to this embodiment, in the first set, the pulse height of the high voltage pulses is set higher than the first voltage level V1, then an excessively intense or strong discharge may be caused whereby the field emission cold cathode device may be broken even the gate electrode and the emitter are connected to each other so that the gate electrode and the emitter have the same potential. In order to avoid this problem, in this embodiment, the high voltage pulses with the waveforms as illustrated in FIG. 5 are applied. the first voltage level V1 of the high voltage pulses in the first set is set substantially equal to the normal high voltage to be applied to the high voltage side electrode in the normal operation of the electron tube in order to suppress the strong or intense discharge thereby preventing the field emission cold cathode device from being broken. As described above, the discharge eliminates or remove the discharge deriving substances from the electrode surfaces. As an amount of the discharge deriving substances on the electrode surfaces is reduced, the voltage level is increased gradually. If the discontinuation or disappearance of the discharge is caused at the time when the pulse height or the voltage level of the high voltage pulses becomes reduced to about 1.5 times of the first voltage level V1 or the normal high voltage level to be applied to the high voltage side electrode in the normal operation of the electron tube, then it may be considered that the discharge processing is sufficient, for which reason no further set of the high voltage pulse is applied, or the application of the high voltage pulses to the high voltage side electrode is finished. Any unnecessary electric discharge processing can be prevented.

In this embodiment, the Bran tube is selected to be one example of the electron tubes in order to describe the present invention which provides the method of carrying out the electric discharge processing or the high voltage knocking process. Notwithstanding, the present invention is also applicable to any electron tube which has at least one field emission cold cathode device. Some types of the other electron tubes than the Braun tube have no low voltage side electrodes positioned between the field emission cold cathode device 1 and the high voltage side electrode, where the all electrodes except for the high voltage side electrode comprise the gate electrode and the emitter electrode of the field emission cold cathode device.

The present invention is applied to the other electron tube so called to as a field emission display, wherein a plurality of field emission cold cathode devices are aligned over a flat plate so that the field emission cold cathode devices emit electron beams which travel toward fluorescent plates. The gate electrode and the emitter electrode as the cathode of each of the field emission cold cathode devices are grounded so that the gate electrode and the emitter electrode have the ground potential. The fluorescent plate is applied with a high voltage to cause the discharge. This discharge eliminate or removes burrs and dusts from surfaces of those electrodes. During the electric discharge processing, the gate electrode and the emitter electrode as the cathode of each of the field emission cold cathode device are connected so that the gate electrode and the emitter electrode remain at the same potential to prevent the field emission cold cathode device from being broken. Elimination or removal of the burrs and dusts from surfaces of the electrodes prevents that any discharge is caused at the electrodes in the normal operation of the field emission display. The discharge also eliminate or remove the factors for current leak passes from inner walls of a vacuum tube or separating wall therein as well as from support columns in addition to the above effect of elimination or removal of the burrs and dusts.

Whereas modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims all modifications which fall within the spirit and scope of the present invention.

What is claimed is:

1. A method of carrying out an electric discharge process during manufacturing processing of an electron tube having at least a field emission cold cathode device, wherein at least a high voltage electrode of said electron tube is maintained in a high voltage range, whilst all electrodes of said electron tube except for said at least a high voltage electrode are maintained in a lower voltage range than said high voltage range to reduce defects disposed upon the electrode surface, wherein the high voltage is higher than a normal operating voltage range for said electron tube.

2. The method as claimed in claim 1, wherein said lower voltage range has a range-width which corresponds to about 30% of a lowest voltage level of said high voltage range.

3. The method as claimed in claim 1, wherein said all electrodes except for said at least high voltage electrode are maintained at the same voltage lower than said high voltage range.

4. The method as claimed in claim 3, wherein said all electrodes except for said at least high voltage electrode are electrically connected to each other.

5. The method as claimed in claim 3, wherein said all electrodes except for said at least high voltage electrode are maintained at a ground potential.

6. The method as claimed in claim 1, wherein said at least high voltage electrode is applied with high voltage pulses.

7. The method as claimed in claim 6, wherein applications of said high voltage pulses to said at least high voltage electrode are made with time intervals between plural sets of said high voltage pulses, and individual sets of said high voltage pulses are different in maximum pulse height, and individual maximum pulse heights of said individual sets of said high voltage pulses discontinuously increase over time.

8. The method as claimed in claim 6, wherein applications of said high voltage pulses to said at least high voltage electrode are made continuously without any time interval, and said pulse height of said high voltage pulses continuously increases.

9. A method of carrying out an electric discharge process during manufacturing processing of an electron tube having at least a field emission cold cathode device, wherein at least a high voltage electrode of said electron tube has applied voltage pulses in a high voltage range, whilst each of all electrodes of said electron tube except for said at least a high voltage electrode has a voltage applied which lies in a lower voltage range than said high voltage range pulse to reduce defects disposed upon the electrode surface, wherein the high voltage range is higher than a normal operating voltage range for said electron tube.

10. The method as claimed in claim 9, wherein said lower voltage range has a range-width which corresponds to about 30% of a height of the high voltage pulses.

11. The method as claimed in claim 9, wherein said all electrodes except for said at least high voltage electrode are applied with the same voltage lower than said high voltage.

12. The method as claimed in claim 11, wherein said all electrodes except for said at least high voltage electrode are electrically connected to each other.

13. The method as claimed in claim 11, wherein said all electrodes except for said at least high voltage electrode are grounded.

14. The method as claimed in claim 9, wherein applications of said high voltage pulses to said at least high voltage electrode are made with time intervals between plural sets of said high voltage pulses, and individual sets of said high voltage pulses are different in maximum pulse height, and individual maximum pulse heights of said individual sets of said high voltage pulses discontinuously increase over time.

15. The method as claimed in claim 9, wherein applications of said high voltage pulses to said at least high voltage electrode are made continuously without any time interval, and said pulse height of said high voltage pulses continuously increases.

* * * * *